United States Patent [19]

Benzon-Petersen et al.

[11] 4,020,618

[45] May 3, 1977

[54] APPARATUS FOR STORAGE AND FEEDING OF BAGS

[75] Inventors: Boye Ditlef Benzon-Petersen, Lund; Istvan Stefan Lorant, Oxie, both of Sweden

[73] Assignee: AB Akerlund & Rausing, Lund, Sweden

[22] Filed: Aug. 31, 1976

[21] Appl. No.: 719,134

[30] Foreign Application Priority Data

Sept. 8, 1975 Sweden ..... 7509940

[52] U.S. Cl. ..... 53/390; 53/188; 53/384; 186/1 A

[51] Int. Cl.[2] ..... B65B 67/12; B65B 43/28

[58] Field of Search ..... 53/390, 384, 188; 186/1 A, 1 AC; 198/300; 271/162, 164

[56] References Cited

UNITED STATES PATENTS

| | | | |
|---|---|---|---|
| 3,077,950 | 2/1963 | Brown | 53/390 X |
| 3,740,922 | 6/1973 | Liou | 53/384 X |

*Primary Examiner*—Travis S. McGehee

*Attorney, Agent, or Firm*—Lerner, David, Littenberg & Samuel

[57] ABSTRACT

Apparatus for manipulating carrying bags which are initially in a planely compressed state in a storage compartment. The bags are held on a carriage which may be rolled into and out of the storage compartment. Drive means secured to the storage compartment mate with driven means on the carriage, which driven means are adapted to feed the compressed bags to an opening and raising station. The opening and raising station includes a bottom plate pivotally mounted about a horizontal axis between a substantially horizontal position in which it supports an open bag and a substantially vertical position in which grip members are adapted to grip a portion of the compressed bag in order to pull the bag into an open form, after which the bottom plate is elevated into a higher position. The movement of the bottom plate is coordinated with two spades adapted to be pushed into a partly raised bag in order to be moved apart therein to maintain the bag in its open form.

6 Claims, 8 Drawing Figures

APPARATUS FOR STORAGE AND FEEDING OF BAGS

SUMMARY OF THE INVENTION

The present invention relates to apparatus for raising carrying bags and comprising a storage compartment for planely compressed carrying bags and means to seize such a planely compressed bag and raise it into open form ready for filling.

At the exit cash desks in self-service stores and similar shops frequently stoppages arise due to the fact that the customers do not have time to pack away their goods as rapidly as the cashier registers the amounts on the cash register. It therefore must be chosen either to give the customer packaging assistance or to allow the cashier to make a short pause between each customer. The object of the present invention is to eliminate this drawback. This has been made possible in that the apparatus according to the invention can be used to automatically raise carrying bags within a moderate reach of the cashier so that cashier can put goods into the carrying bag and simultaneously register the actual amounts on the cash register. Thus, as soon as the cashier has registered the last amount of goods of the customer are already finally packed in one or more carrying bags.

It is important that said storage compartment when necessary may be rapidly and simply filled with new planely compressed bags. This has also been considered at the apparatus according to the invention.

BRIEF DESCRIPTION OF THE DRAWING

In the following the invention is more closely described with reference to the accompanying drawings showing a preferred embodiment of the apparatus according to the invention mounted in a substantially complete cash desk.

DESCRIPTION OF THE PREFERRED EMBODIMENT

Figure 1:
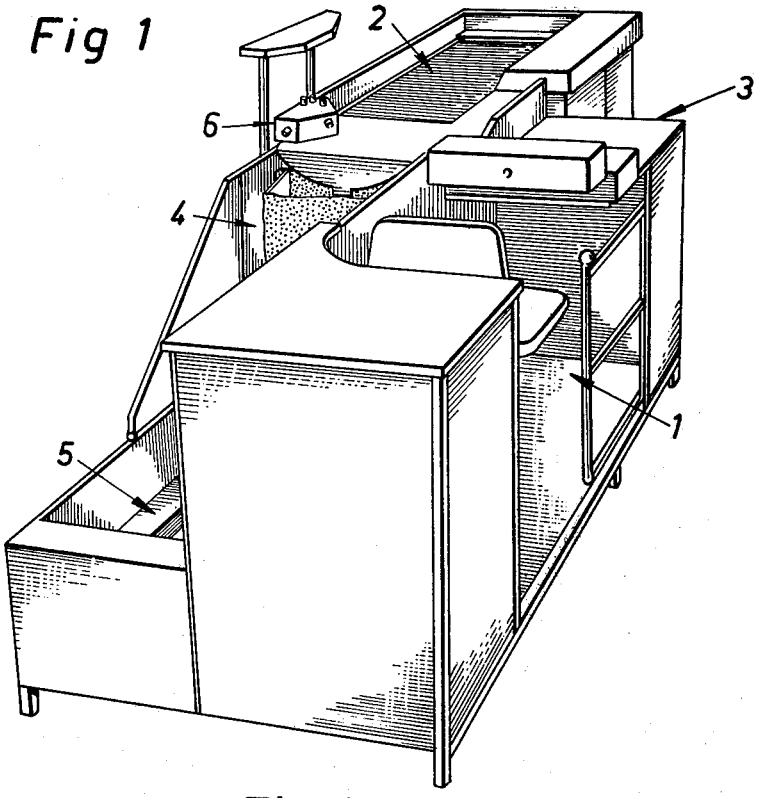
FIG. 1 is a total view of the cash desk. For the sake of plainness the cash register has been omitted.

In FIG. 1 reference numeral 1 indicates the place of the cashier, 2 a belt for the advance of the goods of the customer, 3 the place of a cash register, 4 a raised open carrying bag ready to be filled, 5 a hauling track for the removal of ready raised and filled bags and 6 a control unit with starting and stop buttons for the raising operation and possible pilot lamps.

Figure 2B:
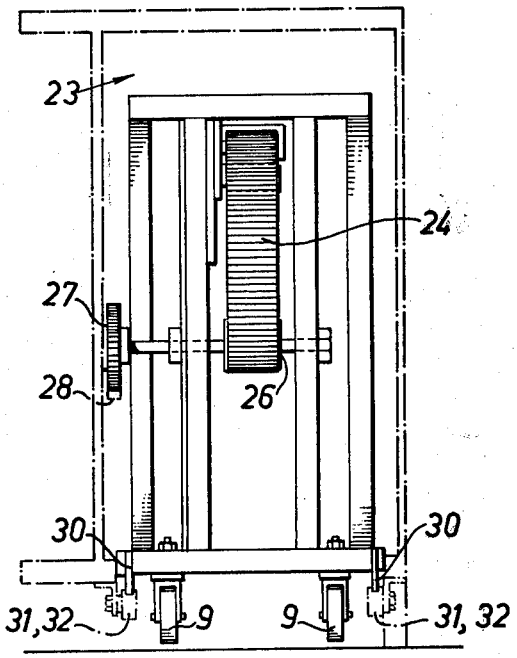
FIGS. 2A and 2B are sections through a part of the cash desk according to FIG. 1. This part of the desk partly comprises a storage compartment for planely compressed carrying bags and means to seize such a planely compressed bag and to raise it into an open form ready for filling.
Figure 2A:
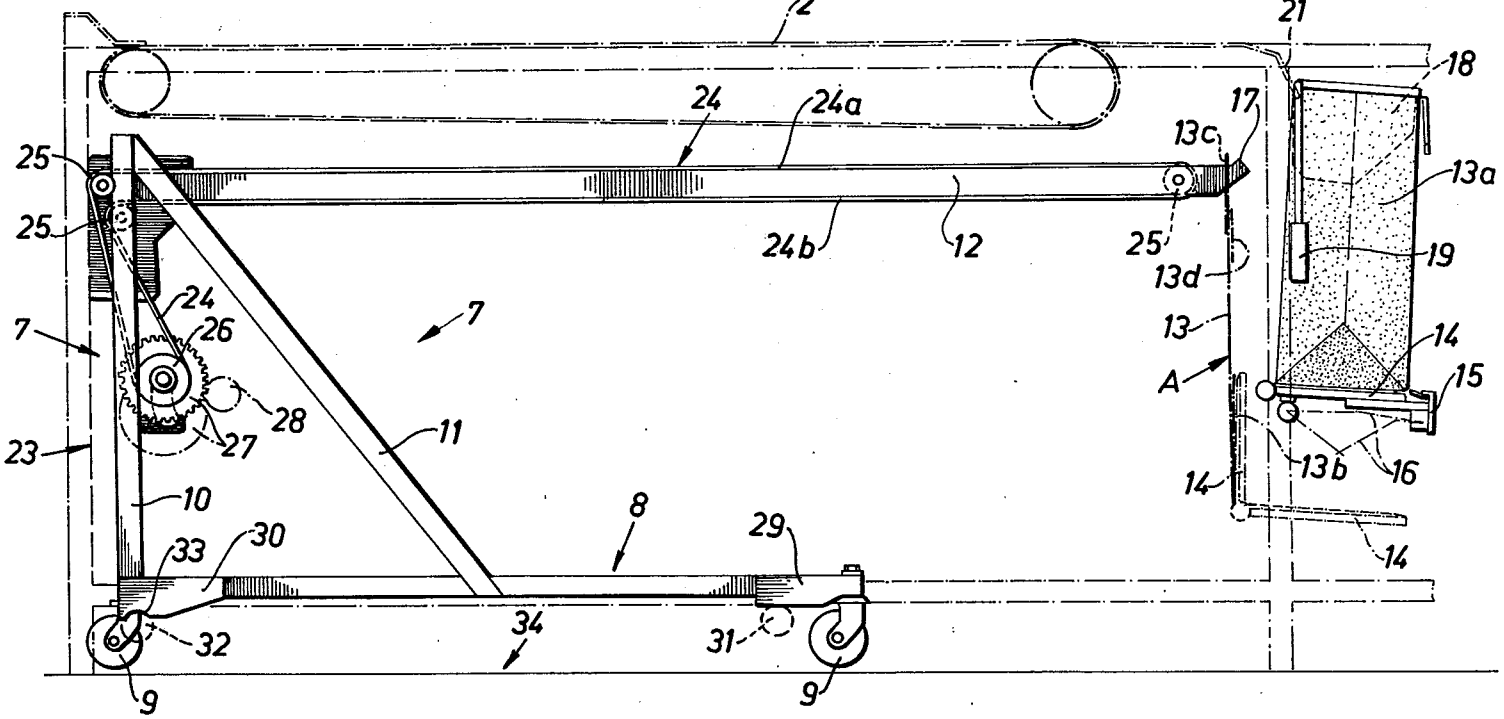

FIGS. 2A and 2B are sections through the conveying belt 2 and the underlying portion of the cash desk. As appears from the drawing a carriage 7 is pushed into the desk, said carriage consisting of a bottom frame 8 mounted on wheels 9, a rear substantially vertical frame portion 10, intermediate supports 11 and a supporting arm 12 mounted on said parts and supporting the planely compressed carrying bags 13. Of the latter, however, for the sake of plainness only one bag is shown. As appears from the drawing this bag is provided with a conventional square bottom formed by a bottom fold **13*b***.

Figure 4:
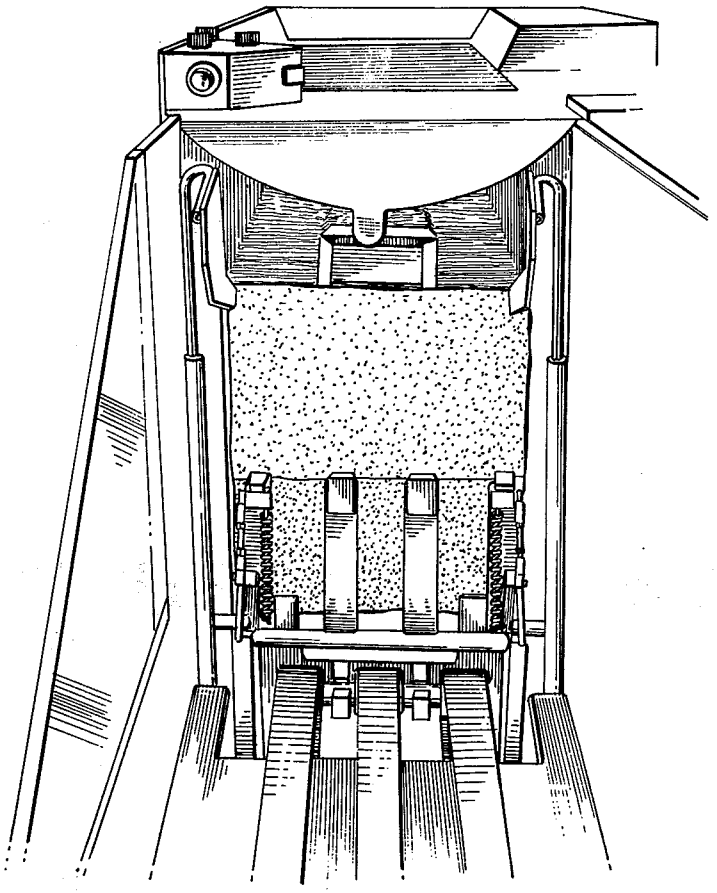
FIGS. 3–7 more closely show said means for the raising of the bag and in various positions during the raising.
Figure 3:
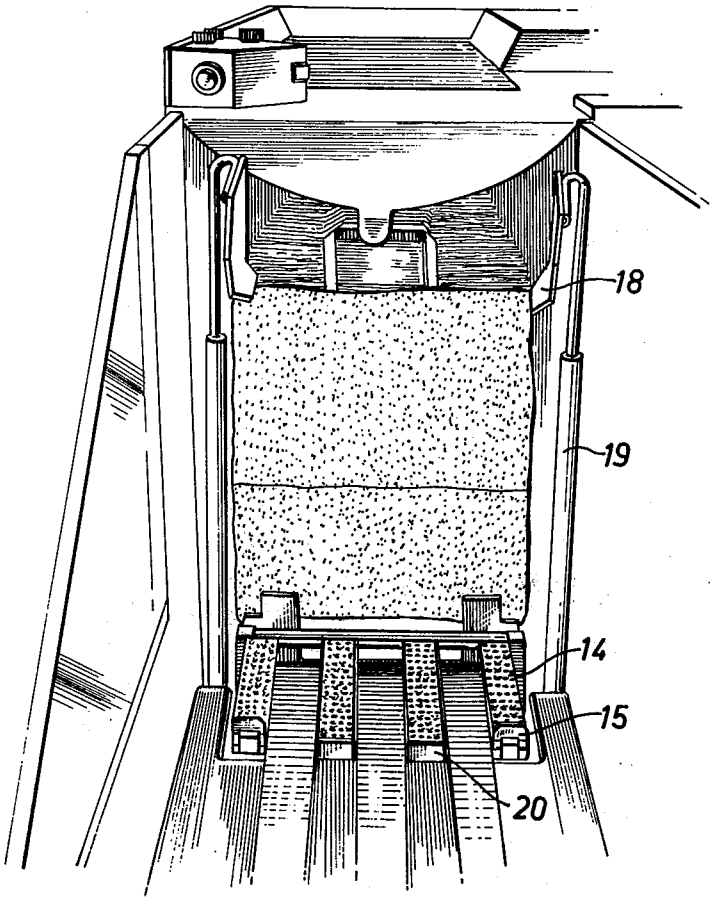
Figure 6:
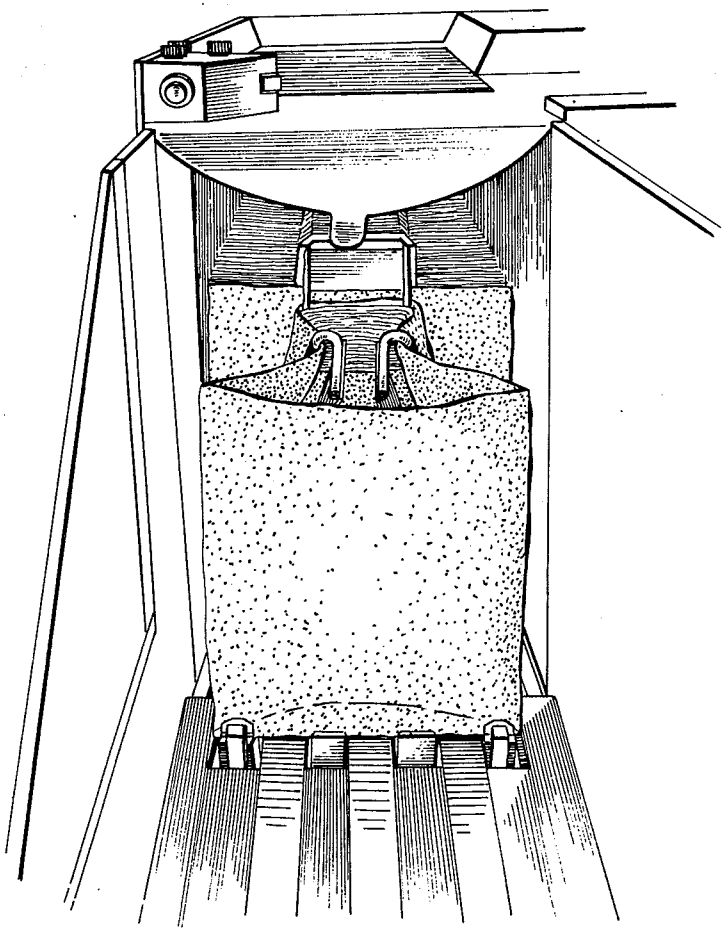
Figure 5:
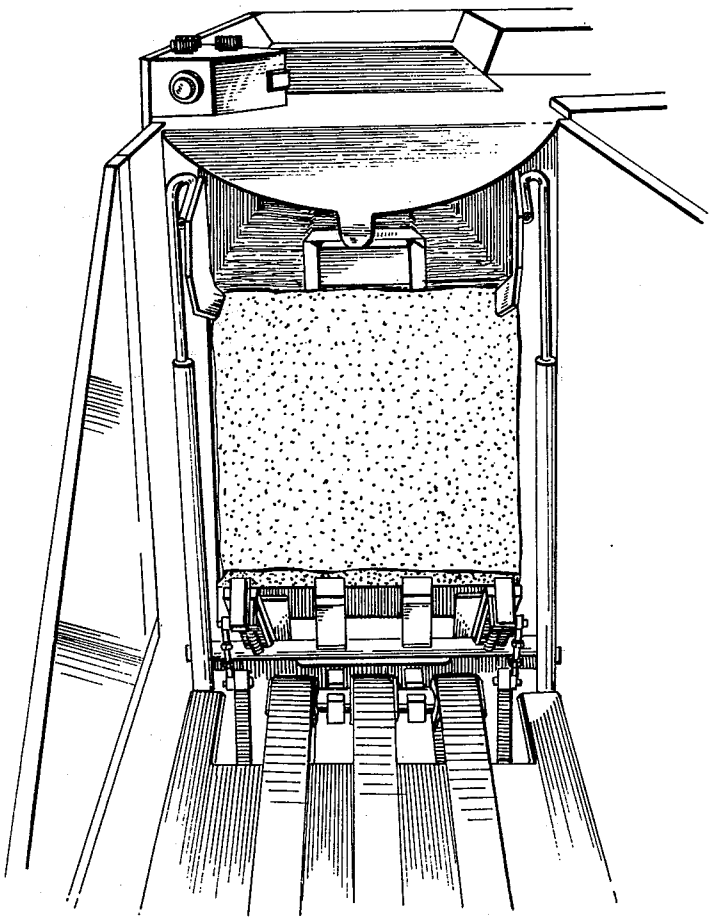
Figure 7:
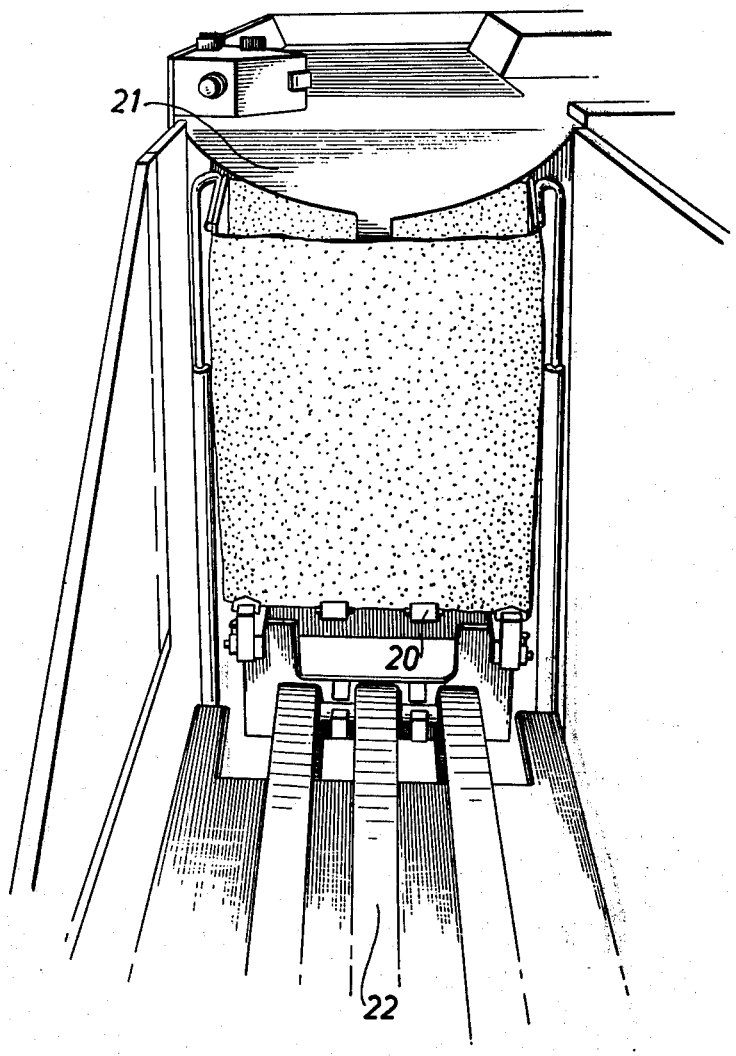

In the drawing reference numeral **13*a* indicates the carrying bag after it has been raised. The means to raise the carrying bag is schematically shown in FIG. 2A. Said means consists of a bottom plate 14 which can be moved between the three positions indicated in the drawing. In the position indicated by full lines the carrying bag 13*a* is completely ready raised and released from grip members 15 which have been used for the raising of the carrying bag. Said grip members 15 are operated by means of a schematically shown toggle-joint mechanism 16. At A the grip member 15 seizes the bottom fold 13*b* of the carrying bag 13. Then the whole bottom plate 14 is turned downwardly into the indicated lower, substantially horizontal position. Simultaneously a carrying handle 13*c* is retained on the supporting arm 12 by means of a stop 17. On this occasion the other carrying handle 13*d* of the carrying bag preferably hangs freely down either on the inside or the outside of the carrying bag. In this state two spades 18 are introduced which are mounted on telescopic arms 19. Said arms are best shown in FIG. 3 which shows an initial position. In this position the bottom plate 14 occupies its lower substantially horizontal position and simultaneously the telescopic arms 19 occupy substantially vertical positions. From this initial position the bottom plate 14, as shown in FIG. 4, is moved upwardly into a substantially vertical position in which the grip members 15 seize the bottom fold 13*b* by means of a replacement of the toggle-joint mechanism 16. It appears from FIG. 5 how the bottom plate is again moved downwardly into a substantially horizontal position while the carrying bag is partly opened. The handle shown in FIG. 5 is the handle 13*c* according to FIG. 2A. The handle 13*d* according to FIG. 2A is folded inwardly against the inside of the carrying bag. At the downward folding the carrying bag is partially opened, as shown in FIG. 6. In this position the spades 18 are brought together while the telescopic arms 19 are contracted so that the spades 18 are introduced into the partially opened carrying bag 13*a*. By means of the bottom plate 14 and the spades 18 the bag then is moved vertically upwardly into the position according to FIG. 2A. This elevation of the bag takes place in order to facilitate the filling and partly in order to release the handle 13*c* from the stop 17. The filling is further facilitated by a protection and guiding plate 21 which is rigidly mounted on the cash desk and arranged to be pushed into the raised bag 13*a* when this is elevated into the higher position, as shown in FIG. 7. The carrying bag 13*a*** now is ready to be filled.

As well during raising as during filling the alignment of the bottom of the carrying bag is facilitated by means of straightening hooks 20. By this means partly the raising proper and partly also the release of the carrying bag from the grip members 15 after the filling is made easier. This release takes place after a lowering of the bottom plate 14 into the initial position from which the filled carrying bag **13*a* is removed by means of conveying belts 22.**

As appears from the illustration series in FIGS. 3–7, the raising and opening of the carrying bag **13*a* may be effected rapidly and safely. In order to attain a frictionless work at the cash desk, however, further a continuous and safe supply of planely compressed carrying bags 13 in the storage is necessary. At the illustrated construction this has been ensured by means of a high-speed loading system comprising a carriage 7 which may be filled with carrying bags 13 at a place remote from the cash desk, for instance an outer storage room. The carriage 7 has partly been described above but will now be more closely described. The carriage 7 is filled with carrying bags suspended to the supporting arm 12. Preferably each carrying bag 13 is arranged with one handle 13***c* suspended to the supporting arm 12 whereas the other handle 13*d* is folded downwardly against the inside or outside of the bag. In FIG. 2A only one bag 13 is shown, in the practice, however, the carriage can accomodate a full daily demand with essential margin of a normal self-service cash desk, so that the carriage only has to be filled once a day, for instance before the opening of the store or after the closing thereof. The carriage 7 is pushed under the belt 2 through an opening 23 which preferably is provided with a door with a locking device in order to prevent an unauthorized person from touching the drive mechanism of a belt 24 the one part 24*a* of which is running along the top side of the arm 12 towards the raising and filling position of the bags 13, and the other part 24*b* of which is running in the opposite direction along the underside of the supporting arm 12. This belt 24 is running over various pulleys 25 and a spanning and driving roller 26. The driving roller 26 is driven by means of a gear wheel 27 which also is mounted on the carriage 7. When the carriage is pushed into the cash desk the gear wheel 27 will automatically engage a gear wheel 28 mounted in the cash desk proper. This gear wheel 28 in turn is driven by a motor (not shown).

In order to ensure that the carriage 7 always will occupy the same position it is provided with supporting rails 29 and 30. The rails run on to supporting rollers 31 and 32 and are locked in a predetermined position in that the supporting rails 30 are provided with recesses 33 corresponding to the supporting rollers 32. Thus, the carriage 7 in its active position will be suspended on the supporting rollers 31 and 32 without contact with the foundation 34 of the desk.

The invention of course is not limited merely to the embodiment described above but may be varied within the scope of the following patent claims. Thus, for instance, the form of many of the various technical parts may be varied without departing from the scope of the invention. Moreover, the invention principle of course also may be applied to other types of carrying bags than the one described above.

We claim:

1. Storage apparatus for storing and individually feeding bags for use with bag handling apparatus, said bag handling apparatus including a storage area, said storage apparatus comprising a carriage member including means for moving said carriage member into and out of said storage area, holding means for holding bags in a planely compressed state, and feeding means for feeding said individual bags from said holding means to said bag handling apparatus when said carriage is in said storage area.

2. The storage apparatus according to claim 1 for use with bag handling apparatus which includes a driving member mounted in said storage area, said carriage member further including means for driving said feeding means, and means for coupling said driving means to said mounted driving member when said carriage member is in said storage area.

3. The storage apparatus according to claim 1 wherein said carriage member further comprises a bottom frame portion and a rear substantially vertical frame portion connected to said bottom frame portion, said moving means including roll members connected to the bottom frame portion for supporting the carriage member for movement along the ground, and said holding means including a support arm mounted on said rear portion for supporting of compressed bags.

4. The storage apparatus according to claim 3 for use with bag handling apparatus having supporting wheels mounted in said storage area, said carriage member further comprising carrying rails mounted on said bottom frame portion which carrying rails have recessed portions adapted to mate with said supporting wheels for supporting the carriage member in a raised position with the roll members freely suspended above the ground when the carriage member is moved into said storage area.

5. The storage apparatus according to claim 1 wherein the bags are of the type having two handles, said holding means comprising a longitudinal supporting arm on which the bags are arranged to be suspended by at least one of their handles, and said feeding means comprises an endless belt, one part of which is adapted to move along the top side of the supporting arm in a feeding direction, and the second part of which is adapted to move in the opposite direction along the underside of the supporting arm.

6. The storage apparatus according to claim 5 for use with bag handling apparatus which includes a driving member mounted in said storage area and gear means operatively associated with said feeding means of said carriage member including means for driving said belt and means for engaging said belt driving means with said driving member gear means when said carriage member is in said storage area.

* * * * *